US006892548B2

(12) United States Patent
Choi et al.

(10) Patent No.: US 6,892,548 B2
(45) Date of Patent: May 17, 2005

(54) ROTARY COMPRESSOR AND REFRIGERANT CYCLE SYSTEM HAVING THE SAME

(75) Inventors: Jin Kyu Choi, Suwon (KR); Cheol Woo Kim, Seongnam (KR); Kook Jeong Seo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/690,583

(22) Filed: Oct. 23, 2003

(65) Prior Publication Data

US 2004/0129017 A1 Jul. 8, 2004

(30) Foreign Application Priority Data

Jan. 8, 2003 (KR) ..... 10-2003-0000949
Sep. 4, 2003 (KR) ..... 10-2003-0061758

(51) Int. Cl.[7] ..... F25B 41/00
(52) U.S. Cl. ..... 62/196.1; 62/228.5
(58) Field of Search ..... 62/196.1, 196.2, 62/196.3, 228.5

(56) References Cited

U.S. PATENT DOCUMENTS 5,201,189 A * 4/1993 Yokomachi et al. ..... 62/196.3
5,927,088 A * 7/1999 Shaw ..... 62/175
6,279,331 B1 * 8/2001 Hirota ..... 62/117
6,619,062 B1 * 9/2003 Shibamoto et al. ..... 62/228.3

OTHER PUBLICATIONS

Korean Patent Abstracts for Publication No. 2000–56701 dated Sep. 15, 2000.
Patent Abstracts of Japan for Publication No. 5–256286 dated Oct. 5, 1993.

* cited by examiner

*Primary Examiner*—William E. Tapolcai
(74) *Attorney, Agent, or Firm*—Staas & Halsey LLP

(57) ABSTRACT

Disclosed herein are a variable capacity rotary compressor and a refrigerant cycle system having the variable capacity rotary compressor. The compressor includes a cooling unit and a pressure reducing unit to reduce temperature and pressure of a bypassed refrigerant, thus allowing the bypassed refrigerant to have the same temperature and pressure as when entering a cylinder at first. The compressor includes the cylinder in which a refrigerant is compressed. An inlet pipe delivers the refrigerant into the cylinder. An outlet pipe delivers the refrigerant out of the cylinder. A bypass hole is provided at a predetermined position of the cylinder to bypass the refrigerant from the cylinder, thus varying a compression capacity. A bypass pipe connects the bypass hole to the inlet pipe to allow the refrigerant bypassed through the bypass hole to enter the cylinder. The cooling unit cools the refrigerant flowing through the bypass pipe. The pressure reducing unit reduces a pressure of the refrigerant which flows through the bypass pipe. Therefore, the refrigerant cycle system having the variable capacity rotary compressor prevents the operational efficiency of a refrigeration cycle from being reduced, in addition to preventing reduction of power consumption, even when the compressor of the refrigerant cycle system is operated in a small capacity compression mode.

15 Claims, 5 Drawing Sheets

ROTARY COMPRESSOR AND REFRIGERANT CYCLE SYSTEM HAVING THE SAME

CROSS-REFERENCE TO RELATED APPLICATIONS

This application claims the benefit of Korean Patent Application No. 2003-949 filed on Jan. 08, 2003 and Korean Patent Application No. 2003-61758 filed on Sep. 04, 2003 in the Korean Intellectual Property Office, the disclosures of which are incorporated herein by reference.

BACKGROUND OF THE INVENTION

1. Field of the Invention

The present invention relates to a variable capacity rotary compressor and a refrigerant cycle system having the variable capacity rotary compressor and, more particularly, to a variable capacity rotary compressor which allows a refrigerant entering the compressor after being bypassed to vary a compression capacity of the compressor, to have same temperature and pressure as when entering the compressor at first, and to a refrigerant cycle system having the variable capacity rotary compressor.

2. Description of the Related Art

As shown in FIG. 1, a conventional variable capacity rotary compressor 10 includes a cylinder 11 in which a refrigerant is compressed, an inlet pipe 12 to deliver the refrigerant into the cylinder 11, an outlet pipe 13 to deliver the refrigerant out of the cylinder 11, a bypass hole 11*a* provided at a predetermined position of the cylinder 11 to bypass the refrigerant from the cylinder 11 for varying a compression capacity, and a bypass pipe 14 to connect the bypass hole 11*a* to the inlet pipe 12 to allow the refrigerant bypassed through the bypass hole 11*a* to enter the cylinder 11. In the cylinder 11 is installed a roller piston 11*b* to be eccentric from a center of the cylinder 11. Further, a vane 11*c* is installed in the cylinder 11 to partition the cylinder 11 into a high-pressure part 11*d* and a low-pressure part 11*e*. The variable capacity rotary compressor also has a control unit to control a flow of the refrigerant which flows through the bypass pipe 14. In this case, the control unit includes a check valve 11*f*, a connection pipe 15, and a three-way valve 16. The check valve 11*f* functions to open or close the bypass hole 11*a*. The connection pipe 15 connects the outlet pipe 13 to the bypass pipe 14. Further, the three-way valve 16 is provided at a junction between the bypass pipe 14 and the connection pipe 15.

The bypass pipe 14 is divided into a first pipe portion 14*a* and a second pipe portion 14*b* by the three-way valve 16. The first pipe portion 14*a* is provided between the bypass hole 11*a* and the three-way valve 16, while the second pipe portion 14*b* is provided between the three-way valve 16 and the inlet pipe 12. The three-way valve 16 is controlled to allow the first pipe portion 14*a* to communicate with the second pipe portion 14*b* or the connection pipe 15.

In the conventional variable capacity rotary compressor 10, the compression capacity is varied by the three-way valve 16. When the three-way valve 16 is controlled to allow the first pipe portion 14*a* to communicate with the connection pipe 15, a pressure of the outlet pipe 13 acts on an outside of the check valve 11*f*, and an internal pressure of the cylinder 11 which is lower than the pressure of the outlet pipe 13, acts on an inside of the check valve 11*f*, thus dosing the check valve 11*f*. In this case, the refrigerant is not bypassed and thereby a large capacity compression mode is executed.

When it is required to execute a small capacity compression mode, the three-way valve 16 is controlled to allow the first pipe portion 14*a* to communicate with the second pipe portion 14*b*. At this time, a pressure of the inlet pipe 12 acts on the outside of the check valve 11*f*, and the internal pressure of the cylinder 11, that is, a pressure of either the high-pressure part 11*d* or the low-pressure part 11*e* of the cylinder 11, acts on the inside of the check valve 11*f* Since the pressure of the high-pressure part 11*d* is higher than the pressure of the inlet pipe 12, a higher pressure acts on the inside of the check valve 11*f* in comparison with the outside of the check valve 11*f*, thus opening the check valve 11*f*. Therefore, while the pressure of the high-pressure part 11*d* acts on the inside of the check valve 11*f*, the refrigerant is bypassed through the check valve 11*f*. In this case, the variable capacity rotary compressor 10 is operated in the small capacity compression mode.

As described above, when the variable capacity rotary compressor 10 is operated in the small capacity compression mode, the refrigerant is bypassed through the bypass pipe 14, and then the bypassed refrigerant enters the cylinder 11 through the inlet pipe 12. However, since the refrigerant bypassed from the cylinder 11 is compressed slightly, the bypassed refrigerant has temperature and pressure which are higher than those of the refrigerant when entering the cylinder 11 at first. As such, when the refrigerant having high temperature and pressure enters the cylinder 11, a mass flow is reduced, due to an increase in a specific volume of the bypassed refrigerant, thus reducing the operational efficiency of a refrigeration cycle. Further, due to an increase in a suction pressure of the compressor 10, power consumption of the compressor 10 is undesirably increased.

SUMMARY OF THE INVENTION

Accordingly, it is an aspect of the present invention to provide a variable capacity rotary compressor which reduces temperature and pressure of a refrigerant bypassed from a cylinder before entering the cylinder again, thus preventing the operational efficiency of a refrigeration cycle from being reduced and preventing an increase in power consumption, when the refrigerant is bypassed.

It is another aspect of the present invention to provide a refrigerant cycle system having the variable capacity rotary compressor.

Additional aspects and/or advantages of the invention will be set forth in part in the description which follows and, in part, will be obvious from the description, or may be learned by practice of the invention.

The above and/or other aspects are achieved by providing a variable capacity rotary compressor, including a cylinder, an inlet pipe, an outlet pipe, a bypass hole, a bypass pipe, a cooling unit, and a pressure reducing unit. A refrigerant is compressed in the cylinder. The inlet pipe delivers the refrigerant into the cylinder. The outlet pipe delivers the refrigerant out of the cylinder. The bypass hole is provided at a predetermined position of the cylinder to bypass the refrigerant from the cylinder, thus varying a compression capacity. The bypass pipe connects the bypass hole to the inlet pipe to allow the refrigerant bypassed through the bypass hole to enter the cylinder. The cooling unit cools the refrigerant flowing through the bypass pipe. The pressure reducing unit reduces a pressure of the refrigerant which flows through the bypass pipe, and is provided on the bypass pipe between the cooling unit and the inlet pipe.

The variable capacity rotary compressor further includes a control unit to control a flow of the refrigerant which flows through the bypass pipe. The control unit includes a check valve to open or close the bypass hole, a connection pipe to connect the outlet pipe to the bypass pipe, and a three-way valve provided at a junction between the bypass pipe and the connection pipe. The bypass pipe has a first pipe portion between the bypass hole and the three-way valve, and a second pipe portion between the three-way valve and the inlet pipe. The three-way valve is controlled to allow the first pipe portion to communicate with the second pipe portion or the connection pipe.

When the three-way valve is controlled to allow the first pipe portion to communicate with the second pipe portion, the check valve is opened to bypass the refrigerant through the bypass hole, thus executing a small capacity compression mode. On the other hand, when the three-way valve is controlled to allow the first pipe portion to communicate with the connection pipe, the check valve is closed to execute a large capacity compression mode.

The above and/or other aspects are achieved by providing a variable capacity rotary compressor, including a cylinder in which a refrigerant is compressed, an inlet pipe to deliver the refrigerant into the cylinder, an outlet pipe to deliver the refrigerant out of the cylinder, a bypass hole provided at a predetermined position of the cylinder to bypass the refrigerant from the cylinder, thus varying a compression capacity, a bypass pipe connecting the bypass hole to the inlet pipe to allow the refrigerant bypassed through the bypass hole to enter the cylinder, and a pressure reducing unit to reduce a pressure of the refrigerant which flows through the bypass pipe. In this case, the pressure reducing unit may comprise a capillary tube.

The above and/or other aspects are achieved by providing a refrigerant cycle system, including a compressor, a condenser, an expander, and an evaporator. In this case, the compressor of the refrigerant cycle system includes a cylinder in which a refrigerant is compressed, an inlet pipe to deliver the refrigerant into the cylinder, an outlet pipe to deliver the refrigerant out of the cylinder, a bypass hole provided at a predetermined position of the cylinder to bypass the refrigerant from the cylinder, thus varying a compression capacity, a bypass pipe connecting the bypass hole to the inlet pipe to allow the refrigerant bypassed through the bypass hole to enter the cylinder, and a cooling unit to cool the refrigerant flowing through the bypass pipe. The cooling unit is provided at a predetermined portion of the condenser.

Further, in the refrigerant cycle system, the rotary compressor further includes a pressure reducing unit to reduce a pressure of the refrigerant which flows through the bypass pipe. The pressure reducing unit is provided on the bypass pipe between the cooling unit and the inlet pipe.

The rotary compressor of the refrigerant cycle system further includes a control unit to control a flow of the refrigerant which flows through the bypass pipe. The control unit includes a check valve to open or close the bypass hole, a connection pipe to connect the outlet pipe to the bypass pipe, and a three-way valve provided at a junction between the bypass pipe and the connection pipe.

The above and/or other aspects are achieved by providing a refrigerant cycle system, including a compressor, a condenser, an expander, and an evaporator. In this case, the compressor of the refrigerant cycle system comprises a variable capacity rotary compressor which includes a cylinder in which a refrigerant is compressed, an inlet pipe to deliver the refrigerant into the cylinder, an outlet pipe to deliver the refrigerant out of the cylinder, a bypass hole provided at a predetermined position of the cylinder to bypass the refrigerant from the cylinder, thus varying a compression capacity, a bypass pipe connecting the bypass hole to the inlet pipe to allow the refrigerant bypassed through the bypass hole to enter the cylinder, and a pressure reducing unit to reduce a pressure of the refrigerant which flows through the bypass pipe.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
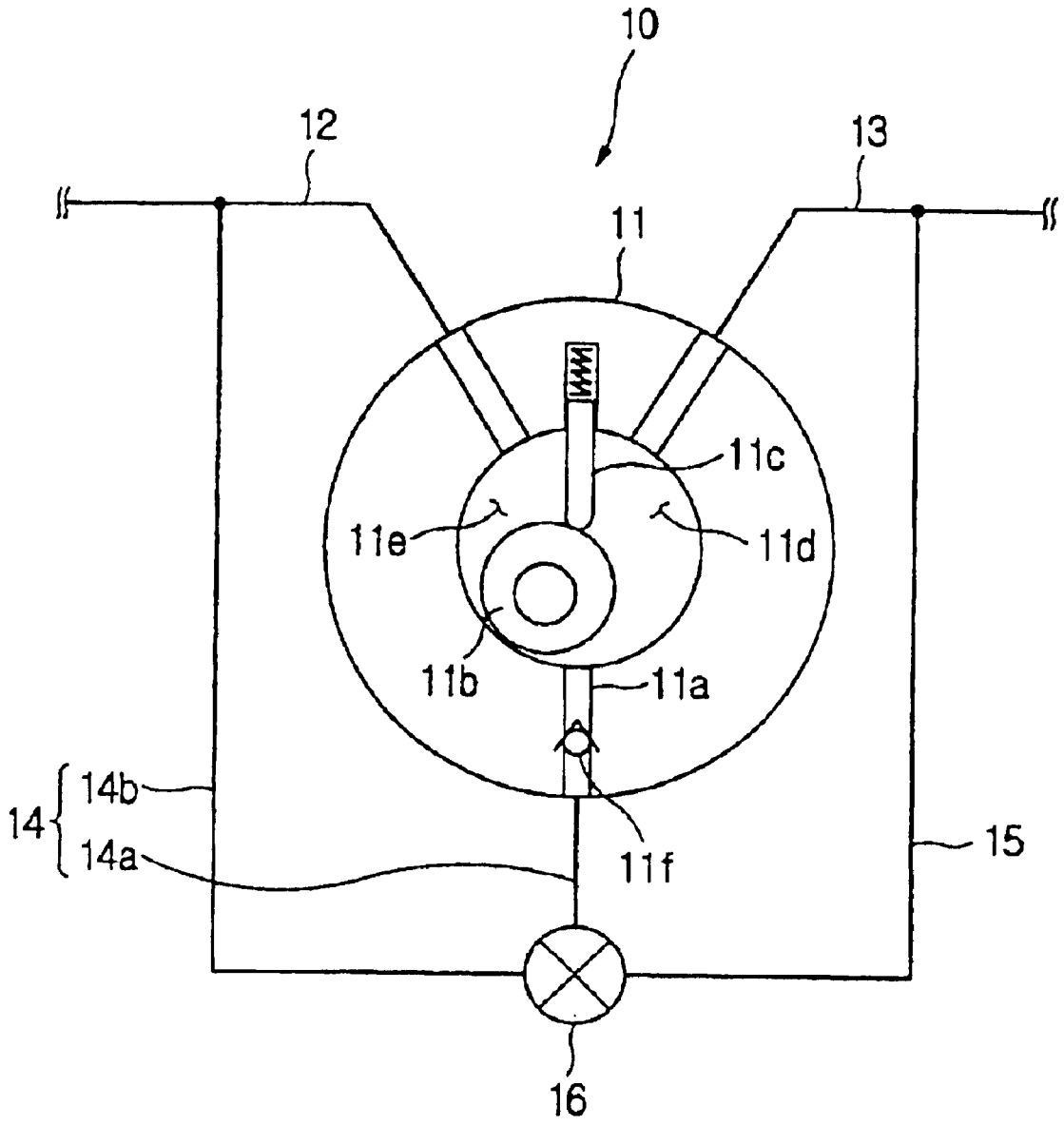
FIG. 1 (PRIOR ART)
FIG. 1 is a schematic view of a conventional variable capacity rotary compressor.

Reference will now be made in detail to the present preferred embodiments of the present invention, examples of which are illustrated in the accompanying drawings, wherein like reference numerals refer to like elements throughout.

Figure 2:
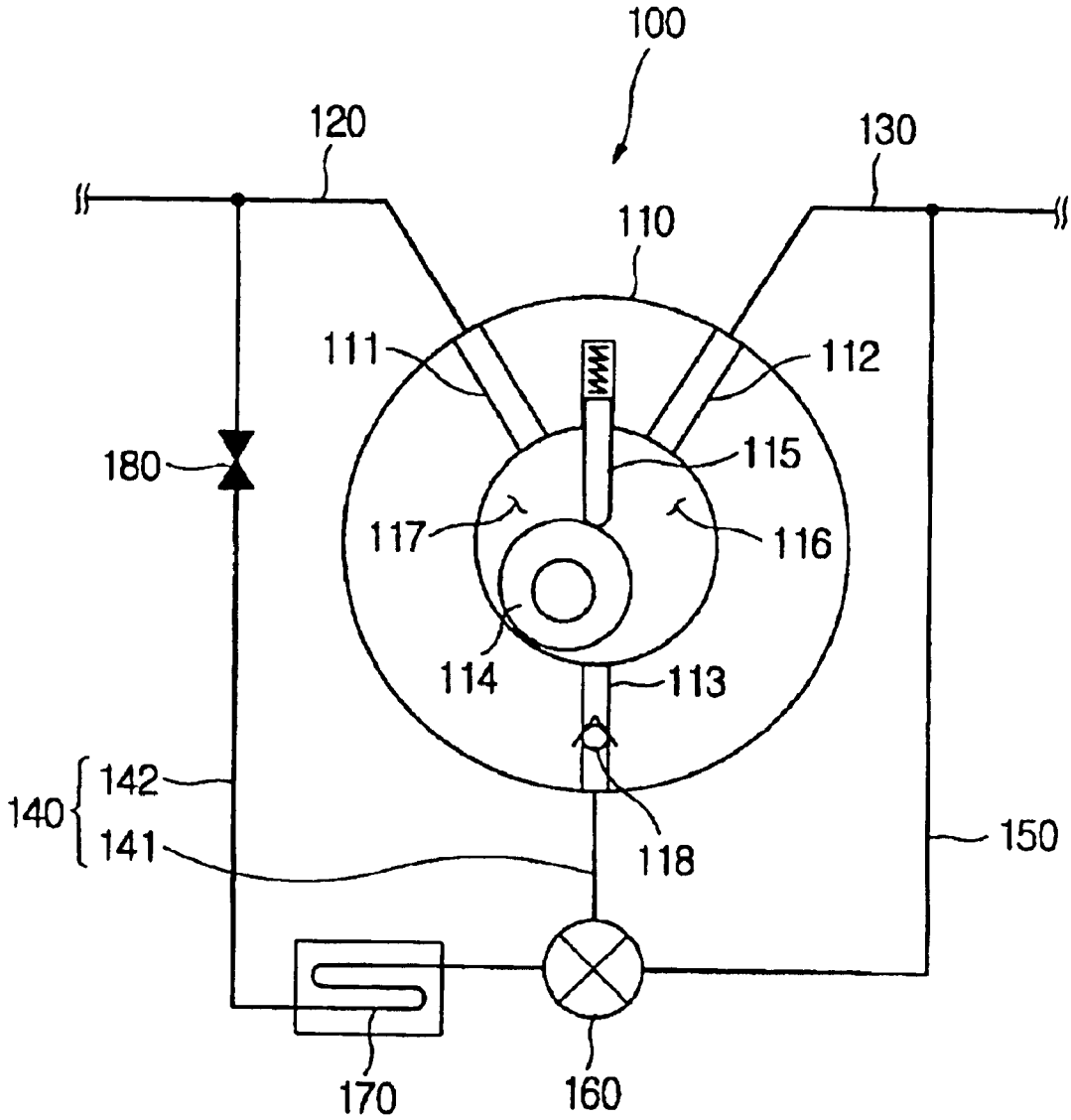
FIG. 2 is a schematic view of a variable capacity rotary compressor, according to an embodiment of the present invention.

As shown in FIG. 2, a variable capacity rotary compressor 100 according to an embodiment of the present invention includes a cylinder 110, an inlet pipe 120, and an outlet pipe 130. The cylinder 110 includes an inlet port 111 into which a refrigerant is drawn, an outlet port 112 through which the refrigerant is discharged, and a bypass hole 113 through which the refrigerant is bypassed. The inlet pipe 120 delivers the refrigerant into the inlet port 111, and the outlet pipe 130 delivers the refrigerant out of the outlet port 112.

In the cylinder 110 are installed a roller piston 114, a vane 115, and a check valve 118. The roller piston 114 is installed in the cylinder 110 to be eccentric from a center of the cylinder 110, and is rotated along an inner surface of the cylinder 110 to compress the refrigerant. The vane 115 partitions the cylinder 110 into a high-pressure part 116 and a low-pressure part 117. The check valve 118 functions to open or dose the bypass hole 113.

The bypass hole 113 is connected to the inlet pipe 120 via the bypass pipe 140 to allow the refrigerant discharged through the bypass hole 113 to enter the cylinder 110. Further, the bypass pipe 140 is connected to the outlet pipe 130 via the connection pipe 150. A three-way valve 160 is provided at a junction between the bypass pipe 140 and the connection pipe 150.

The check valve 118, the connection pipe 150, and the three-way valve 160 constitute a control unit to control a flow of the refrigerant which flows through the bypass pipe 140.

The bypass pipe 140 includes a first pipe portion 141 between the bypass hole 113 and the three-way valve 160, and a second pipe portion 142 between the three-way valve 160 and the inlet pipe 120. The three-way valve 160 is controlled to allow the first pipe portion 141 to communicate with the second pipe portion 142 or the connection pipe 150. Further, a cooling unit 170 and a pressure reducing unit 180 are respectively provided at predetermined positions of the second pipe portion 142 to cool the refrigerant flowing through the second pipe portion 142 and reduce a pressure of the refrigerant flowing through the second pipe portion 142.

Figure 3:
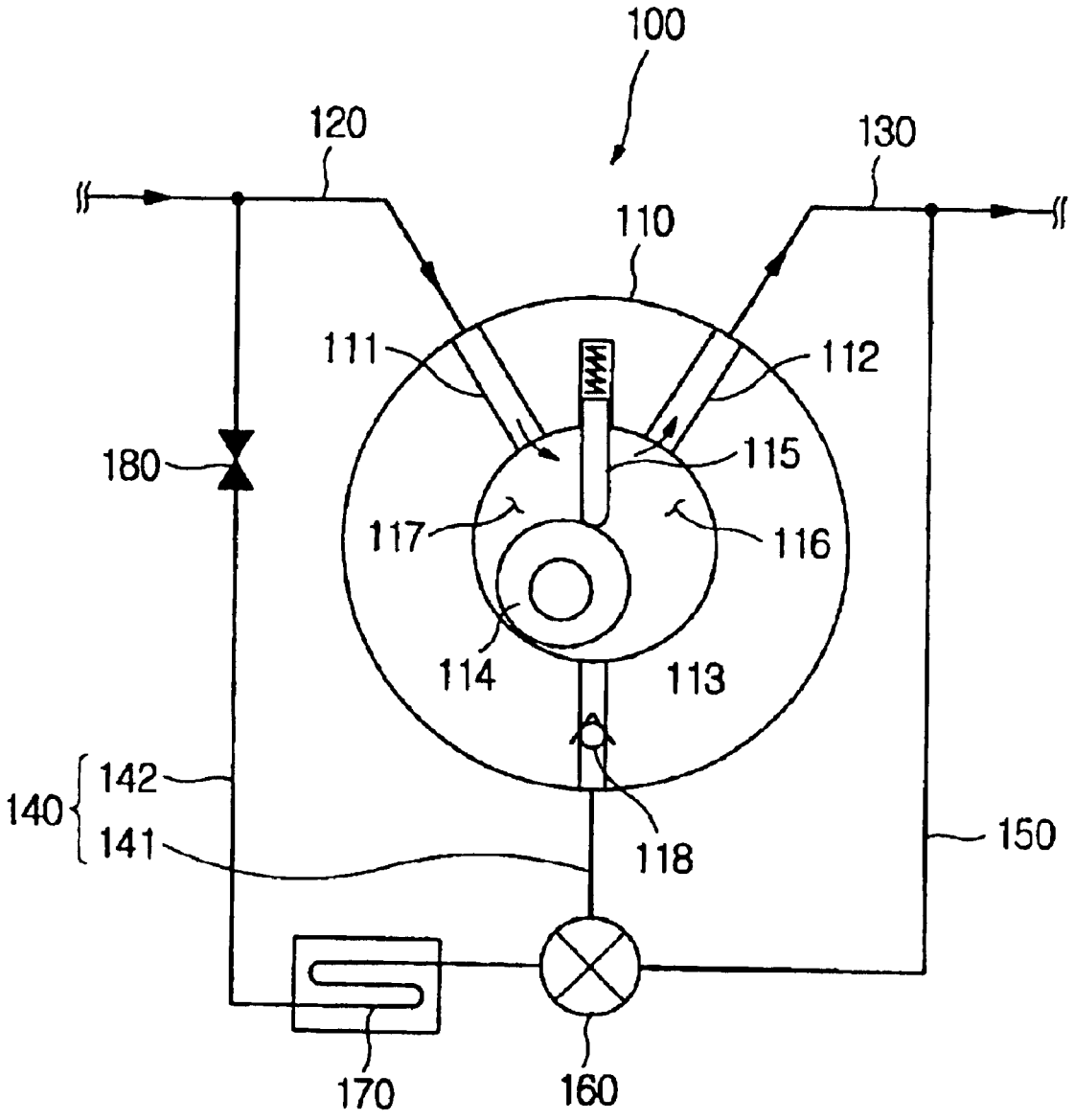
FIG. 3 is a schematic view of the variable capacity rotary compressor of FIG. 2, when the compressor is operated in a large capacity compression mode.
Figure 4:
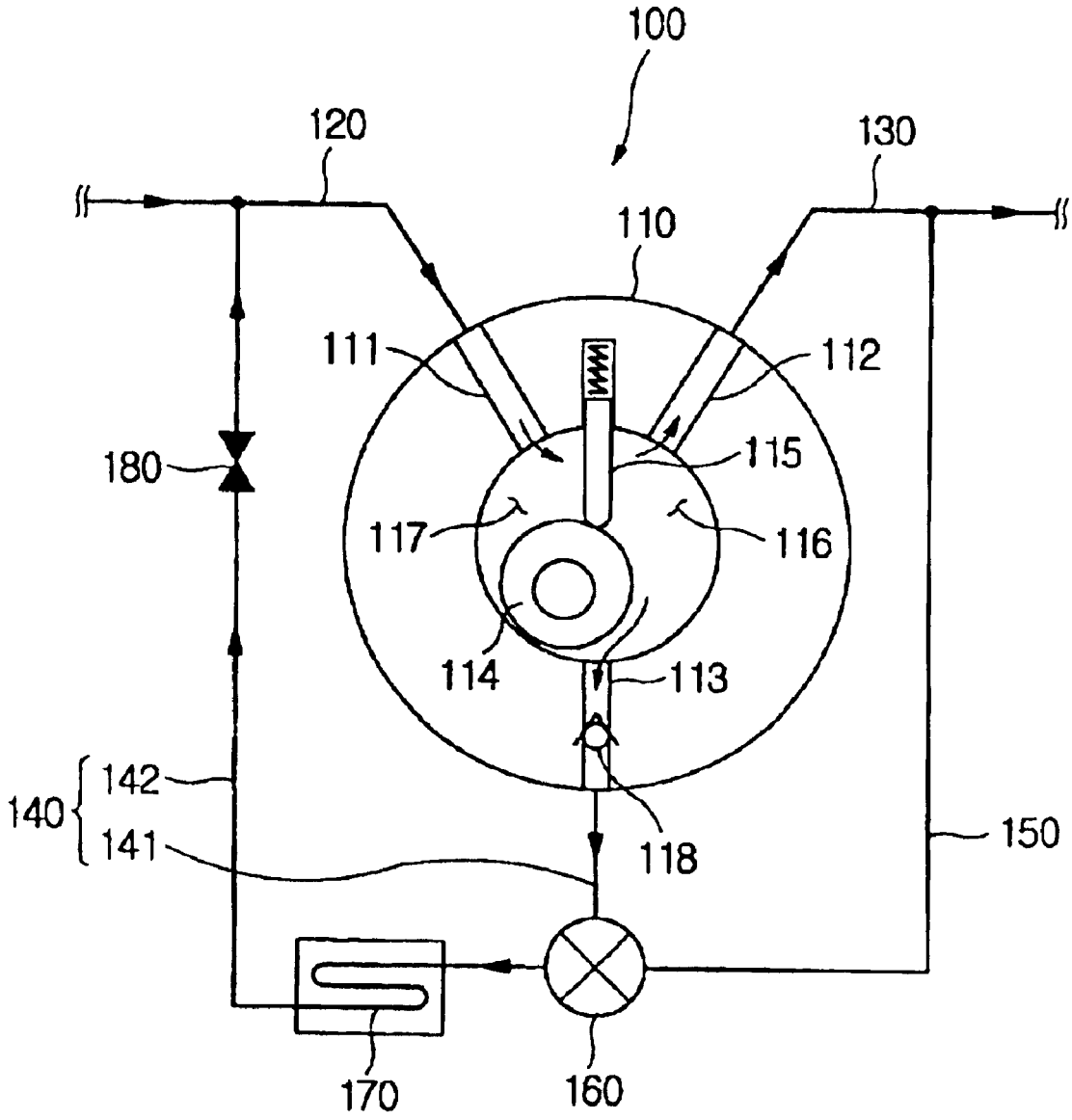
FIG. 4 is a schematic view of the variable capacity rotary compressor of FIG. 2, when the compressor is operated in a small capacity compression mode.

FIG. 3 is a schematic view of the variable capacity rotary compressor 100, when the compressor 100 is operated in a large capacity compression mode. FIG. 4 is a schematic view of the variable capacity rotary compressor 100, when the compressor 100 is operated in a small capacity compression mode. The operation of the variable capacity rotary compressor 100 will be described in the following with reference to FIGS. 3 and 4.

The refrigerant is drawn into the cylinder 110 through the inlet pipe 120 to be compressed. After the refrigerant is compressed, the refrigerant is discharged to the outlet pipe 130. Depending on whether the refrigerant is bypassed through the bypass hole 113 of the cylinder 110, the amount of the refrigerant discharged through the outlet pipe 130 is varied, thus varying the compression capacity of the compressor 100.

The compression capacity of the compressor 100 is varied by controlling the three-way valve 160. When it is required to execute the large capacity compression mode, the three-way valve 160 is controlled to allow the first pipe portion 141 of the bypass pipe 140 to communicate with the connection pipe 150. Since the connection pipe 150 is connected to the outlet pipe 130, a pressure of the outlet pipe 130 acts on the check valve 118 through the connection pipe 150 and the first pipe portion 141 of the bypass pipe 140 communicating with the connection pipe 150.

In this case, the pressure of the outlet pipe 130 acts on an outside of the check valve 118, while a pressure of either the high-pressure part 116 or the low-pressure part 117 acts on an inside of the check valve 118. While the refrigerant is compressed, an internal pressure of the cylinder 110 is lower than the pressure of the outlet pipe 130. Thus, a higher pressure acts on the outside of the check valve 118, in comparison with the inside of the check valve 118.

Therefore, the check valve 118 is closed. At this time, the refrigerant in the cylinder 110 is not bypassed but the entire refrigerant is discharged through the outlet port 112. Such a flow of the refrigerant is shown by arrows of FIG. 3.

Conversely, when it is required to execute the small capacity compression mode, the three-way valve 160 is controlled to allow the first pipe portion 141 of the bypass pipe 140 to communicate with the second pipe portion 142 of the bypass pipe 140. Since the bypass pipe 140 is connected to the inlet pipe 120, a pressure of the inlet pipe 120 acts on the check valve 118.

In this case, since the outside of the check valve 118 communicates with the inlet pipe 120 through the first and second pipe portions 141 and 142 of the bypass pipe 140, the pressure of the inlet pipe 120 acts on the outside of the check valve 118. According to a position of the roller piston 114, the pressure of the high-pressure part 116 or the low-pressure part 117 acts on the inside of the check valve 118. Since the pressure of the high-pressure part 116 is higher than the pressure of the inlet pipe 120, the inside of the check valve 118 has a higher pressure than the outside of the check valve 118 while the pressure of the high-pressure part 116 acts on the inside of the check valve 118. Thus, the check valve 118 is opened to bypass the refrigerant through the bypass hole 113. The bypassed refrigerant enters the cylinder 110 after sequentially passing through the bypass pipe 140 and the inlet pipe 120. Such a flow of the refrigerant is shown by arrows of FIG. 4.

At the predetermined positions of the bypass pipe 140 are provided the cooling unit 170 to cool the refrigerant and the pressure reducing unit 180 to reduce the pressure of the refrigerant. The operation of the cooling unit 170 and the pressure reducing unit 180 is as follows.

Since the refrigerant bypassed from the cylinder 11 is slightly compressed, the temperature and pressure of the bypassed refrigerant are increased. When the bypassed refrigerant having increased temperature and pressure enters the cylinder 11 again, a specific volume of the bypassed refrigerant is increased due to the increased temperature and thereby a mass flow is reduced, thus causing a reduction of the operational efficiency of a refrigeration cycle. Further, due to the increased pressure, a suction pressure of the compressor 100 is increased, thus increasing power consumption of the compressor 100.

In order to solve the problems, the cooling unit 170 and the pressure reducing unit 180 are provided at the predetermined positions of the bypass pipe 140. The cooling unit 170 functions to cool the bypassed refrigerant, and the pressure reducing unit 180 functions to reduce the pressure of the bypassed refrigerant, thus allowing the bypassed refrigerant to have the same temperature and pressure as when entering the cylinder 110 at first.

The pressure reducing unit 180 may comprise a capillary tube, or an expansion valve. The cooling unit 170 may comprise a heat exchanger. It is preferable that the cooling unit 170 be provided at a predetermined portion of a condenser 200 included in a refrigerant cycle system to which the variable capacity rotary compressor 100 of the present invention is applied, without an additional heat exchanger. Such a construction will be described hereinafter.

Figure 5:
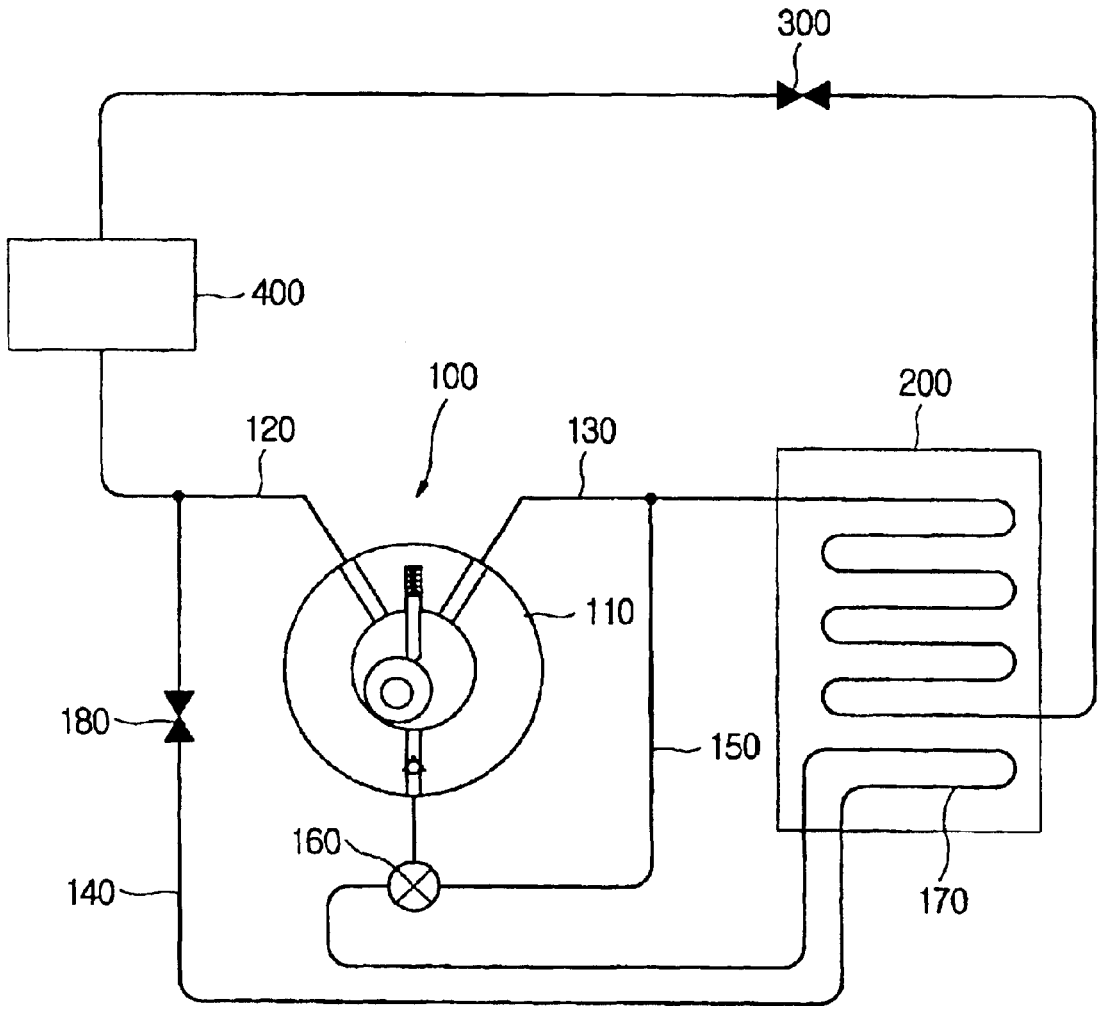
FIG. 5 is a schematic view of a refrigerant cycle system having the variable capacity rotary compressor of FIG. 2.

FIG. 5 is a schematic view of the refrigerant cycle system having the variable capacity rotary compressor 100 according to an embodiment of the present invention. As shown in FIG. 5, the refrigerant cycle system includes a compressor 100, the condenser 200, an expander 300, and an evaporator 400 which constitute a single refrigeration cycle. The compressor 100 compresses the refrigerant. The condenser 200 condenses the refrigerant fed from the compressor 100 to change a gas refrigerant into a liquid refrigerant. The expander 300 reduces the pressure of the refrigerant fed from the condenser 200. The evaporator 400 changes the liquid refrigerant under low pressure into a gas refrigerant.

The compressor applied to the refrigerant cycle system comprises the variable capacity rotary compressor 100 which is described above. The variable capacity rotary compressor 100 includes the bypass pipe 140 to bypass the refrigerant, thus controlling the discharged amount of the refrigerant At the predetermined positions of the bypass pipe 140 are provided the cooling unit 170 and the pressure-reducing unit 180. The cooling unit 170 functions to cool the bypassed refrigerant, and the pressure reducing unit 180 functions to reduce the pressure of the bypassed refrigerant, thus allowing the bypassed refrigerant to have the same temperature and pressure as when entering the cylinder 110 at first As shown in FIG. 5, the cooling unit 170 executes a heat exchanging process using a part of the condenser 200 included in the refrigerant cycle system, thus being capable of cooling the bypassed refrigerant without any additional heat exchanger.

As apparent from the above description, the present invention provides a variable capacity rotary compressor and a refrigerant cycle system having the variable capacity rotary compressor. The variable capacity rotary compressor applied to the refrigerant cycle system, includes a bypass pipe to bypass a refrigerant from a cylinder so that the bypassed refrigerant enters the cylinder through an inlet pipe. At predetermined positions of the bypass pipe are provided a cooling unit and a pressure reducing unit. The cooling unit functions to cool the bypassed refrigerant, and the pressure reducing unit functions to reduce the pressure of the bypassed refrigerant, thus allowing the bypassed refrigerant to have the same temperature and pressure as when entering the cylinder at first, therefore preventing a mass flow from being reduced, due to an increase in a specific volume resulting from an increase in temperature of the bypassed refrigerant, in addition to preventing an increase in a suction pressure of the compressor. Thus, the operational efficiency of a refrigeration cycle is prevented from being reduced, in addition to preventing an increase in power consumption.

Further, since a part of a condenser is used as the cooling unit of the bypass pipe without an additional heat exchanger, additional installation costs and a space for installing the cooling unit are not required.

Although an embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a cylinder in which a refrigerant is compressed;

an inlet pipe to deliver the refrigerant into the cylinder;

an outlet pipe to deliver the refrigerant out of the cylinder;

a bypass hole provided at a predetermined position of the cylinder to bypass the refrigerant from the cylinder, thus varying a compression capacity;

a bypass pipe connecting the bypass hole to the inlet pipe to allow the refrigerant bypassed through the bypass hole to enter the cylinder; and a cooling unit to cool the refrigerant flowing through the bypass pipe.

2. The variable capacity rotary compressor according to claim 1, further comprising a pressure reducing unit to reduce a pressure of the refrigerant which flows through the bypass pipe.

3. The variable capacity rotary compressor according to claim 2, wherein the pressure reducing unit is provided on the bypass pipe between the cooling unit and the inlet pipe.

4. The variable capacity rotary compressor according to claim 3, further comprising a control unit to control a flow of the refrigerant which flows through the bypass pipe.

5. The variable capacity rotary compressor according to claim 4, wherein the control unit comprises:

a check valve to open or dose the bypass hole;

a connection pipe to connect the outlet pipe to the bypass pipe; and a three-way valve provided at a junction between the bypass pipe and the connection pipe, the bypass pipe comprising a first pipe portion between the bypass hole and the three-way valve and a second pipe portion between the three-way valve and the inlet pipe, and the three-way valve being controlled to allow the first pipe portion to communicate with the second pipe portion or the connection pipe.

6. The variable capacity rotary compressor according to claim 5, wherein, when the three-way valve is controlled to allow the first pipe portion to communicate with the second pipe portion, the check valve is opened to bypass the refrigerant through the bypass hole, thus executing a small capacity compression mode, and when the three-way valve is controlled to allow the first pipe portion to communicate with the connection pipe, the check valve is closed to execute a large capacity compression mode.

7. The variable capacity rotary compressor according to claim 5, wherein the cooling unit and the pressure reducing unit are provided at predetermined positions of the second pipe portion of the bypass pipe.

8. A variable capacity rotary compressor, comprising:

a cylinder in which a refrigerant is compressed;

an inlet pipe to deliver the refrigerant into the cylinder;

an outlet pipe to deliver the refrigerant out of the cylinder;

a bypass hole provided at a predetermined position of the cylinder to bypass the refrigerant from the cylinder, thus varying a compression capacity;

a bypass pipe connecting the bypass hole to the inlet pipe to allow the refrigerant bypassed through the bypass hole to enter the cylinder; and a pressure reducing unit to reduce a pressure of the refrigerant which flows through the bypass pipe.

9. The variable capacity rotary compressor according to claim 8, wherein the pressure reducing unit comprises a capillary tube.

10. A refrigerant cycle system, comprising a compressor, a condenser, an expander, and an evaporator, the compressor comprising a variable capacity rotary compressor which comprises:

a cylinder in which a refrigerant is compressed;

an inlet pipe to deliver the refrigerant into the cylinder;

an outlet pipe to deliver the refrigerant out of the cylinder;

a bypass hole provided at a predetermined position of the cylinder to bypass the refrigerant from the cylinder, thus varying a compression capacity;

a bypass pipe connecting the bypass hole to the inlet pipe to allow the refrigerant bypassed through the bypass hole to enter the cylinder; and a cooling unit to cool the refrigerant flowing through the bypass pipe.

11. The refrigerant cycle system according to claim 10, wherein the cooling unit is provided at a predetermined portion of the condenser.

12. The refrigerant cycle system according to claim 10, wherein the variable capacity rotary compressor further comprises a pressure reducing unit to reduce a pressure of the refrigerant which flows through the bypass pipe.

13. The refrigerant cycle system according to claim 12, wherein the pressure reducing unit is provided on the bypass pipe between the cooling unit and the inlet pipe.

14. The refrigerant cycle system according to claim 10, wherein the compressor further comprises a control unit to control a flow of the refrigerant which flows through the bypass pipe, the control unit comprising:

a check valve to open or close the bypass hole;

a connection pipe to connect the outlet pipe to the bypass pipe; and a three-way valve provided at a junction between the bypass pipe and the connection pipe.

15. A refrigerant cycle system, comprising a compressor, a condenser, an expander, and an evaporator, the compressor comprising a variable capacity rotary compressor which comprises:

a cylinder in which a refrigerant is compressed;

an inlet pipe to deliver the refrigerant into the cylinder;

an outlet pipe to deliver the refrigerant out of the cylinder;

a bypass hole provided at a predetermined position of the cylinder to bypass the refrigerant from the cylinder, thus varying a compression capacity;

a bypass pipe connecting the bypass hole to the inlet pipe to allow the refrigerant bypassed through the bypass hole to enter the cylinder; and a pressure reducing unit to reduce a pressure of the refrigerant which flows through the bypass pipe.

* * * * *

UNITED STATES PATENT AND TRADEMARK OFFICE

CERTIFICATE OF CORRECTION

PATENT NO. : 6,892,548 B2
DATED : May 17, 2005
INVENTOR(S) : Jin Kyu Choi et al.

It is certified that error appears in the above-identified patent and that said Letters Patent is hereby corrected as shown below:

Column 7,
Line 59, change “dose” to -- close --.

Signed and Sealed this

Seventh Day of March, 2006

JON W. DUDAS
*Director of the United States Patent and Trademark Office*